US006810545B1

(12) United States Patent
Darling et al.

(10) Patent No.: US 6,810,545 B1
(45) Date of Patent: Nov. 2, 2004

(54) INFANT SUPPORT PILLOW AND METHOD OF ASSEMBLING THE SAME

(75) Inventors: Sandra M. Darling, Niceville, FL (US); Denise A. Rowell, Lancaster, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/419,978

(22) Filed: Apr. 22, 2003

Related U.S. Application Data

(63) Continuation of application No. 09/792,046, filed on Feb. 26, 2001, now abandoned, which is a continuation of application No. 29/132,462, filed on Nov. 12, 2000, now Pat. No. Des. 450,516.

(51) Int. Cl.[7] ..... A41G 9/00
(52) U.S. Cl. ..... 5/655; 5/657; 5/630
(58) Field of Search ..... 5/655, 657, 652, 5/630, 636, 640, 643

(56) References Cited

U.S. PATENT DOCUMENTS

| | | | |
|---|---|---|---|
| 355,873 | A | 1/1887 | Humphrey |
| 808,217 | A | 12/1905 | Reich |
| 909,453 | A | 1/1909 | Pullman |
| RE12,952 | E | 5/1909 | Reich |
| 1,776,122 | A | 9/1930 | Krasnick |
| 1,787,832 | A | 1/1931 | Mueller |
| 1,861,668 | A | 6/1932 | Tenney |
| D94,702 | S | 2/1935 | Marks |
| 2,167,622 | A | 8/1939 | Bentivoglio |
| 2,199,479 | A | 5/1940 | Cappel |
| D124,296 | S | 12/1940 | Thompson |
| 2,336,707 | A | 12/1943 | Thompson |
| 2,498,203 | A | 2/1950 | Fischer |
| 2,561,931 | A | 7/1951 | Kleiser, Jr. |
| 2,795,802 | A | 6/1957 | Myers |
| 2,961,668 | A | 11/1960 | Hayes |
| 3,241,160 | A | 3/1966 | Ecobars |
| D207,248 | S | 3/1967 | Morse et al. |

(List continued on next page.)

FOREIGN PATENT DOCUMENTS

| | | |
|---|---|---|
| DE | 195057 | 1/1958 |
| DE | 40 24 807 A1 | 2/1992 |
| DE | 4237792 A1 | 5/1993 |
| FR | 1076118 | 10/1954 |
| FR | 2379268 | 9/1978 |
| GB | 656514 A | 8/1951 |
| GB | 1322225 | 7/1973 |
| GB | 1508809 | 4/1978 |
| GB | 2175802 A | 12/1986 |
| JP | 410234546 A | 9/1998 |

OTHER PUBLICATIONS

Lots4tots, Stack 'n Play Plus, http://www.lots4tots.com/stacknplay.html.

Stack 'n Play Plus (1 page).

Advertisement for "New Boppy" infant support pillow with play bar (no date).

U.S. patent application Ser. No. 09/679,139 to Matthews filed Oct. 3, 2000.

*Primary Examiner*—Robert G. Santos
(74) *Attorney, Agent, or Firm*—Cooley Godward LLP

(57) ABSTRACT

A pillow that has a body including a medial region and two cantilever arms is disclosed. Each of the cantilever arms extends from the medial region and includes a free end. The cantilever arms and the medial region are spaced apart to define an interior region. The interior region and the pillow body are substantially U-shaped.

9 Claims, 5 Drawing Sheets

U.S. PATENT DOCUMENTS

| | | | |
|---|---|---|---|
| 3,347,544 | A | 10/1967 | Uffenorde |
| 3,400,413 | A | 9/1968 | Grossa |
| 3,493,228 | A | 2/1970 | Hicks et al. |
| 3,667,074 | A | 6/1972 | Emery |
| 3,840,916 | A | 10/1974 | Jennings |
| 3,848,281 | A | 11/1974 | Mathews |
| 3,911,512 | A | 10/1975 | Plate |
| 4,060,863 | A | 12/1977 | Craig |
| 4,173,048 | A | 11/1979 | Varaney |
| 4,197,604 | A | 4/1980 | Nakamura |
| 4,236,264 | A | 12/1980 | Britzman |
| 4,285,081 | A | 8/1981 | Price |
| 4,297,994 | A | 11/1981 | Bashaw |
| 4,345,347 | A | 8/1982 | Kantor |
| 4,383,713 | A | 5/1983 | Roston |
| 4,434,513 | A | 3/1984 | Welch |
| 4,617,691 | A | 10/1986 | Monti et al. |
| 4,679,262 | A | 7/1987 | Davis et al. |
| 4,726,085 | A | 2/1988 | Antonio |
| 4,731,890 | A | 3/1988 | Roberts |
| 4,779,297 | A | 10/1988 | Sturges |
| 4,783,866 | A | 11/1988 | Simmons et al. |
| 4,788,728 | A | 12/1988 | Lake |
| 4,828,321 | A | 5/1989 | Harper |
| 4,852,598 | A | 8/1989 | Griesenbeck |
| 4,858,259 | A | 8/1989 | Simmons et al. |
| 4,892,357 | A | 1/1990 | Nieto-Busby et al. |
| 4,914,765 | A | 4/1990 | Smith |
| 4,945,584 | A | 8/1990 | LaMantia |
| 4,980,937 | A | 1/1991 | Mason et al. |
| D316,793 | S | 5/1991 | Manjarrez |
| 5,026,315 | A | 6/1991 | Chap |
| 5,027,457 | A | 7/1991 | Sweet |
| 5,056,533 | A | 10/1991 | Solano |
| 5,103,514 | A | 4/1992 | Leach |
| D328,683 | S | 8/1992 | Kalozdi |
| 5,154,649 | A | 10/1992 | Pender |
| 5,165,130 | A | 11/1992 | Wendling |
| D338,333 | S | 8/1993 | Walker |
| 5,261,134 | A | 11/1993 | Matthews |
| D342,855 | S | 1/1994 | Butler, II |
| 5,279,237 | A | 1/1994 | Alivizatos |
| 5,313,678 | A | 5/1994 | Redewill |
| 5,339,472 | A | 8/1994 | Yin |
| 5,341,530 | A | 8/1994 | Ward |
| 5,344,437 | A | 9/1994 | Pistay |
| 5,367,731 | A | 11/1994 | O'Sullivan |
| 5,371,909 | A | 12/1994 | McCarty |
| 5,392,785 | A | 2/1995 | Donahue |
| 5,441,479 | A | 8/1995 | Chitwood |
| 5,454,781 | A | 10/1995 | Chitwood |
| 5,467,782 | A | 11/1995 | Wiseman |
| 5,519,906 | A | 5/1996 | Fanto-Chan |
| 5,544,378 | A | 8/1996 | Chow |
| 5,546,620 | A | 8/1996 | Matthews |
| 5,551,108 | A | 9/1996 | Butler, III |
| 5,566,682 | A | 10/1996 | Yavitz |
| 5,581,833 | A | 12/1996 | Zenoff |
| 5,642,750 | A | 7/1997 | Brown et al. |
| 5,661,861 | A | 9/1997 | Matthews |
| 5,664,828 | A | 9/1997 | Simon |
| 5,675,853 | A | 10/1997 | Linge |
| 5,718,011 | A | 2/1998 | Nogues |
| 5,732,999 | A | 3/1998 | Petrie |
| 5,790,999 | A | 8/1998 | Clark |
| 5,800,368 | A | 9/1998 | Kilngemann et al. |
| 5,813,066 | A | 9/1998 | Gebhard et al. |
| 5,836,024 | A | 11/1998 | Uglehus et al. |
| 5,928,054 | A | 7/1999 | Mast |
| 5,930,854 | A | 8/1999 | O'Neill et al. |
| D416,745 | S | 11/1999 | Noyes |
| 6,003,177 | A | 12/1999 | Ferris |
| 6,006,381 | A | 12/1999 | Tandrup |
| 6,029,295 | A | 2/2000 | Larmour et al. |
| 6,038,720 | A | 3/2000 | Matthews et al. |
| 6,041,715 | A | 3/2000 | Jarke et al. |
| 6,052,848 | A | 4/2000 | Kelly |
| 6,055,687 | A | 5/2000 | Matthews |
| 6,061,854 | A | 5/2000 | Crowley |
| 6,119,873 | A | 9/2000 | Matthews |
| 6,279,185 | B1 | 8/2001 | Matthews |
| D450,516 | S | 11/2001 | Darling et al. |
| 2001/0008214 | A1 | 7/2001 | Matthews |
| 2001/0037957 | A1 | 11/2001 | Matthews |
| 2002/0014436 | A1 | 2/2002 | Matthews et al. |
| 2002/0029422 | A1 | 3/2002 | Matthews |
| 2002/0042953 | A1 | 4/2002 | Matthews-Brown |

INFANT SUPPORT PILLOW AND METHOD OF ASSEMBLING THE SAME

CROSS-REFERENCE TO RELATED APPLICATION

The present application is a continuation of U.S. patent application Ser. No. 09/792,046, entitled "Infant Support Pillow and Method of Assembling the Same," filed Feb. 26, 2001 now abandoned, the entire disclosure of which is incorporated by reference in its entirety, which is a continuation of U.S. Design patent application Ser. No. 29/132,462, entitled "Infant Support Pillow," filed Nov. 13, 2000, now U.S. Design Pat. No. D450,516, the disclosure of which is incorporated herein by reference in its entirety. The present application is also related to U.S. Design patent application Ser. No. 29/142,292, entitled "Infant Support Pillow," filed May 24, 2001, now U.S. Design Pat. No. D450,517.

FIELD OF THE INVENTION

The present invention relates to a pillow, and more particularly, to a pillow that can be used to provide support and entertainment for an infant.

BACKGROUND OF THE INVENTION

A popular category of pillows are generally referred to as infant support pillows. Infant support pillows can be used to provide support to an infant in a variety of positions.

SUMMARY OF THE INVENTION

A pillow according to an embodiment of the invention has a body including a medial region and two cantilever arms. Each of the cantilever arms extends from the medial region and includes a free end. The cantilever arms and the medial region are spaced apart to define an interior region. The interior region and the pillow body are substantially U-shaped.

In one embodiment, pockets are provided on the U-shaped body. In another embodiment, sleeves are coupled to the U-shaped body.

In one embodiment, an entertainment device is coupled to the U-shaped body. The entertainment device includes an elongate member with two ends. In one embodiment, the elongate member is a bar. Each of the bar ends can be inserted into a sleeve so that the bar is supported above a portion of the pillow body. Articles, such as, toys, can be coupled to the bar.

DETAILED DESCRIPTION OF THE PREFERRED EMBODIMENTS

A pillow according to an embodiment of the invention is illustrated in FIGS. 1–5. Pillow 5 includes a body 10 having a medial region 12 and cantilever arms 14, 16 extending therefrom. The medial region 12 and arms 14, 16 are spaced apart to define an interior region 22.

Figure 1:
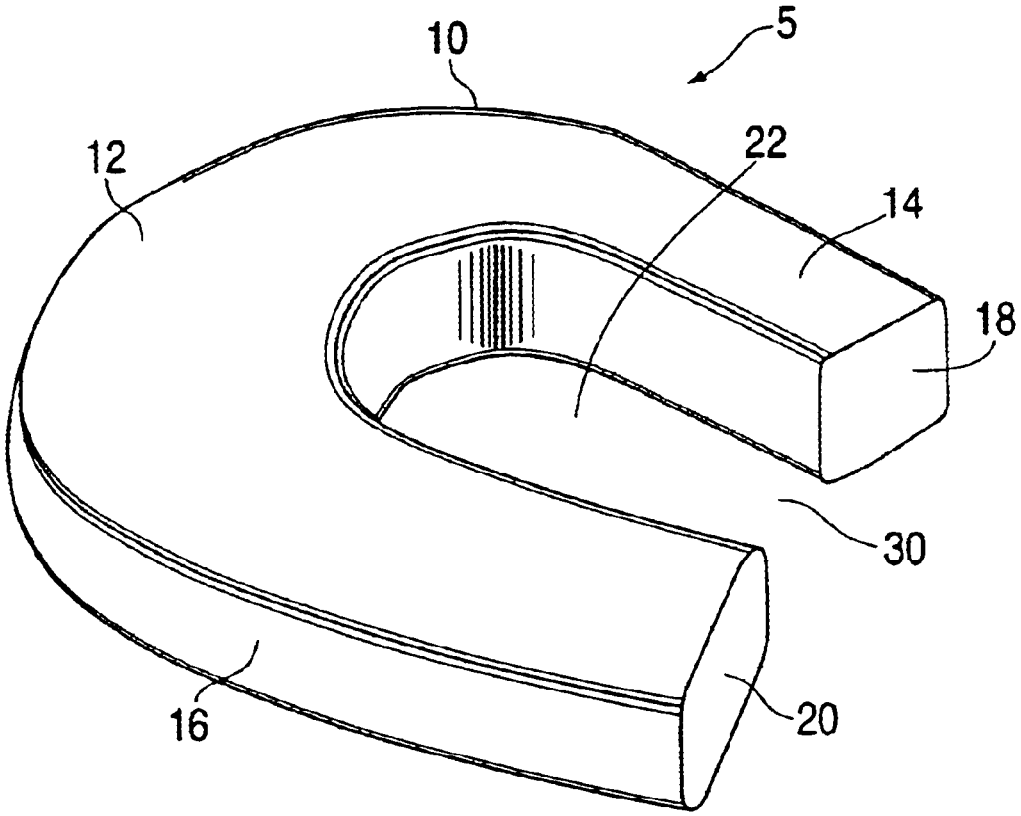
FIG. 1 is a perspective view of an embodiment of a pillow according to the invention.
Figure 2:
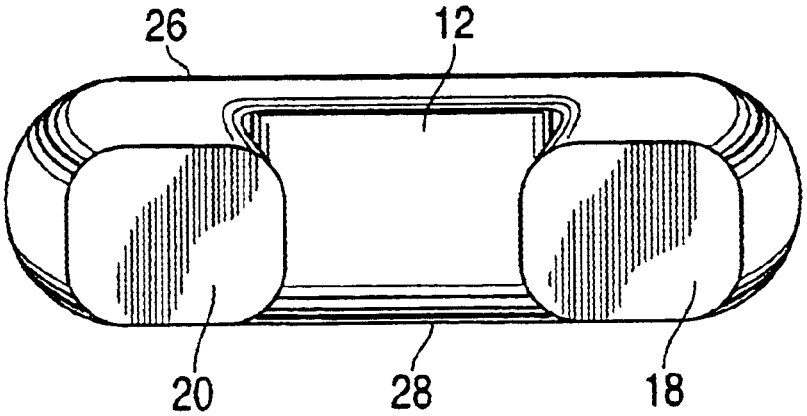
FIG. 2 is a front end view of the pillow of FIG. 1.
Figure 3:
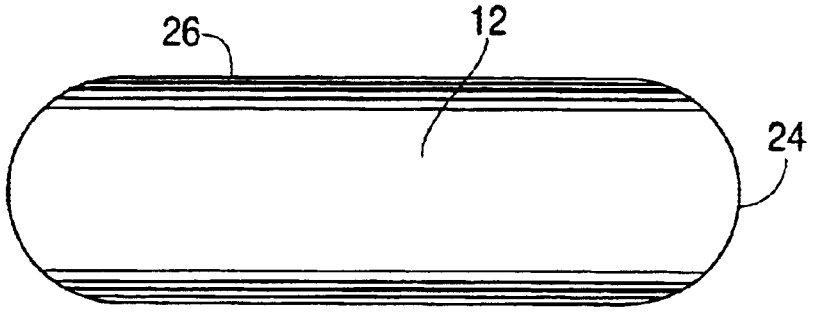
FIG. 3 is a rear end view of the pillow of FIG. 1.

As illustrated in FIG. 1, arms 14, 16 include free ends 18, 20, respectively. In a relaxed or unbiased configuration, arms 14, 16 are oriented so that a space 30 is defined between arm ends 18, 20. In one embodiment, arms 14, 16 have substantially rectangular cross-sections. As illustrated in FIG. 2, ends 18, 20 are substantially rectangular in cross-section.

In the illustrated embodiment, the pillow body 10 is substantially U-shaped or horse-shoe shaped. Similarly, the interior region 22 is substantially U-shaped or horse-shoe shaped as illustrated in FIG. 4.

Figure 5:
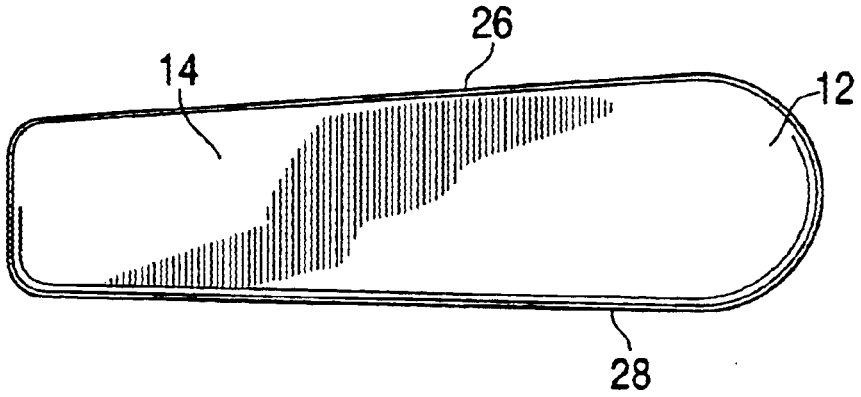
FIG. 5 is a side view of the pillow of FIG. 1.

In the illustrated embodiment, the height of the medial region 12 is larger than the heights of the ends 18, 20 of the arms 14, 16. The pillow body 10 includes an upper surface 26 and a lower surface 28. As illustrated in FIG. 5, the upper surface 26 and lower surface 28 slope towards one another from the medial region 12 to ends 18, 20.

Figure 4:
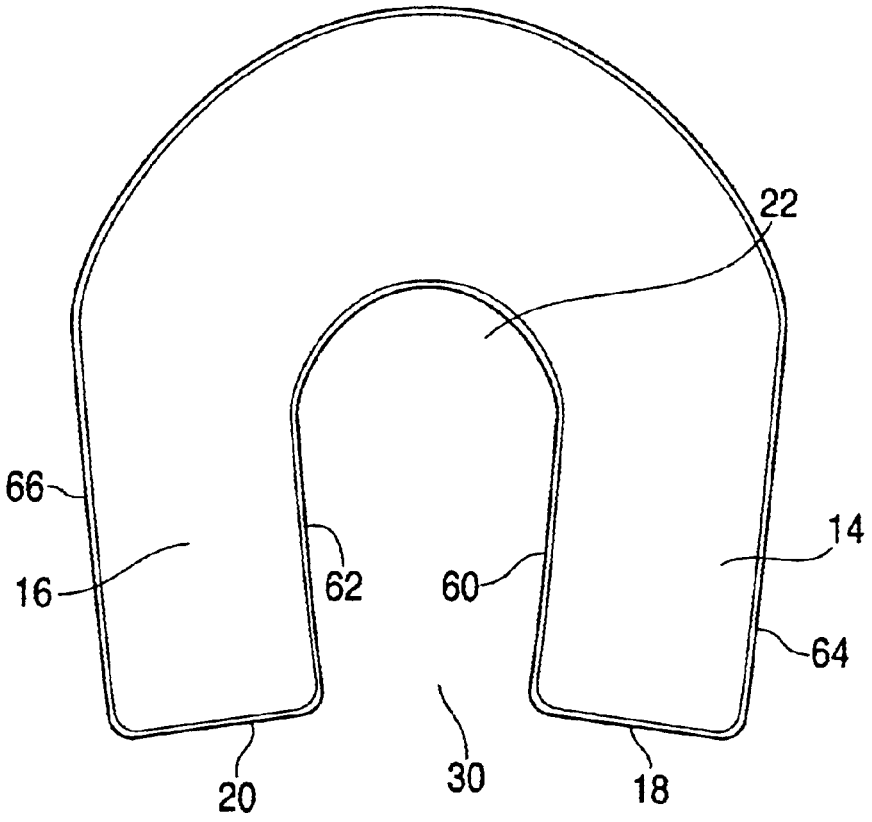
FIG. 4 is a plan view of the pillow of FIG. 1.

As illustrated in FIG. 4, arm 14 includes an inner surface 60 and an outer surface 64. Similarly, arm 16 includes an inner surface 62 and an outer surface 66. In the illustrated embodiment, inner surface 60 and outer surface 64 are substantially parallel to each other. Also, inner surface 62 and outer surface 66 are substantially parallel to each other.

The pillow body 10 includes a fabric cover and a soft, resilient cushion body. In one embodiment, the fabric cover includes several pieces of fabric that are sewn together around the cushion body. The fabric cover may be cotton, nylon, or any other suitable fabric. The cushion body may be foam, rubber, an inflatable body, or any other resilient material.

Figure 6:
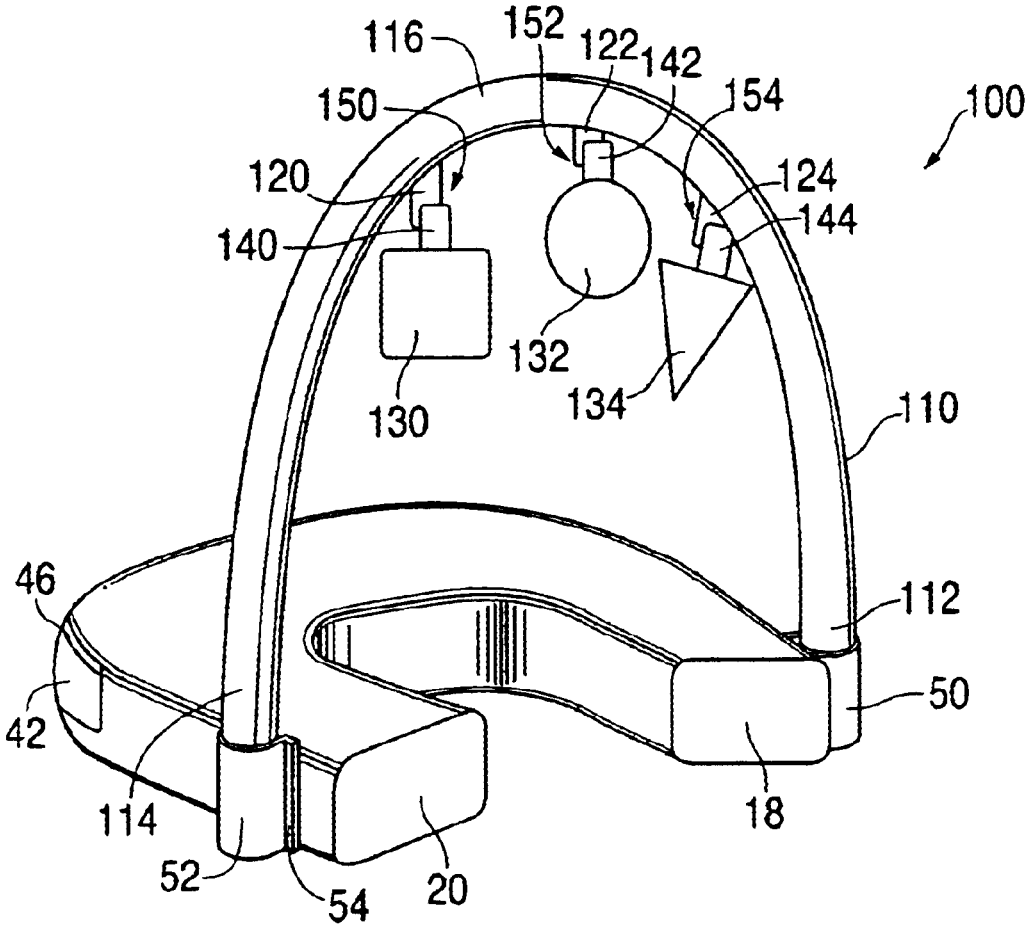
FIG. 6 is a perspective view of an alternative embodiment of a pillow according to the invention.
Figure 7:
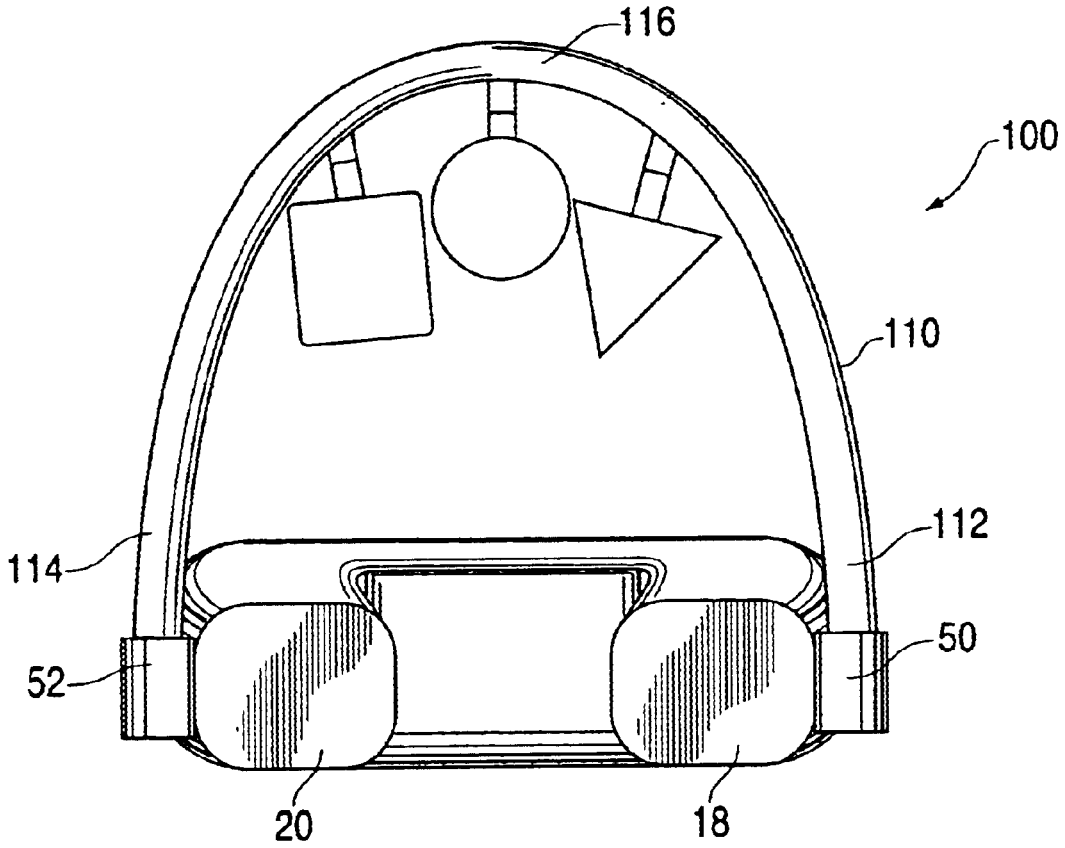
FIG. 7 is a front end view of the pillow of FIG. 6.
Figure 8:
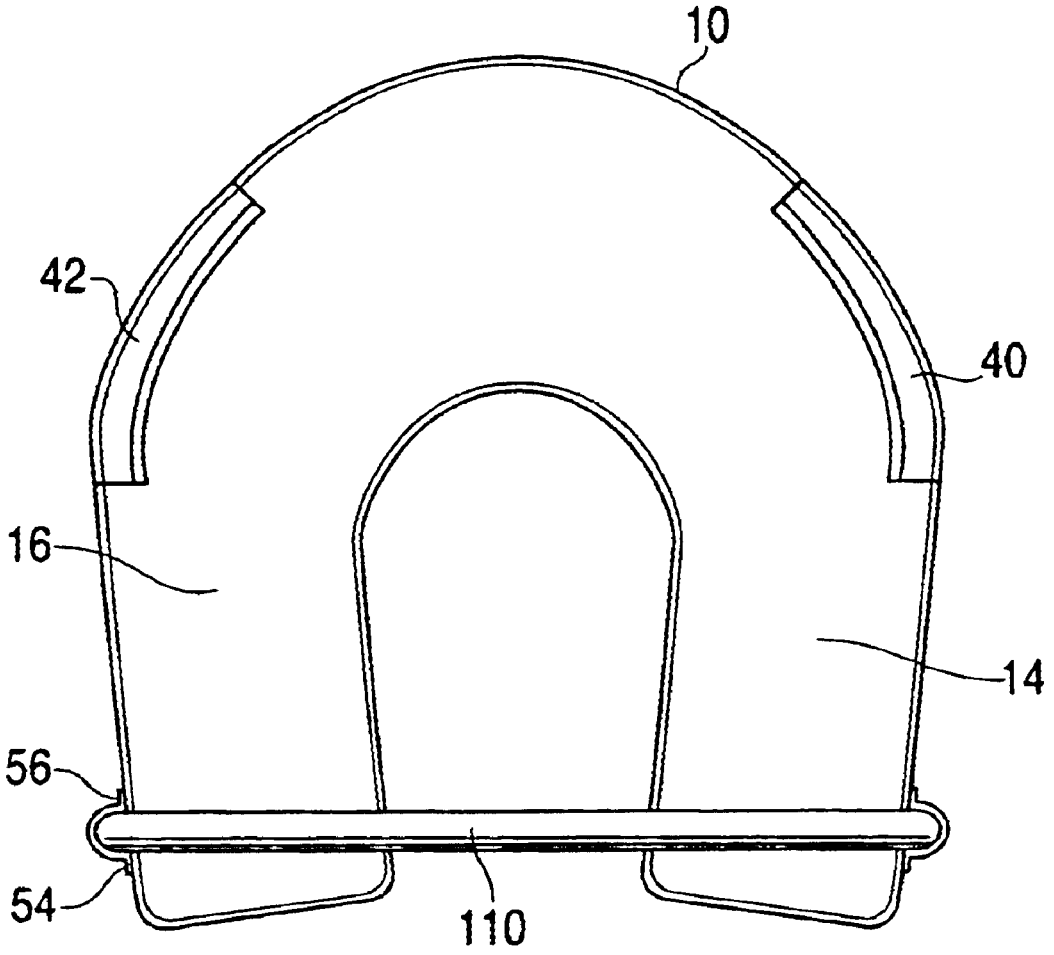
FIG. 8 is a plan view of the pillow of FIG. 6.

An alternative embodiment of a pillow is illustrated in FIGS. 6–8. In this embodiment, an entertainment device 100 is coupled to the pillow body 10.

Pillow 5 includes pockets 40, 42 coupled to the outer surface of the pillow body 10. In one embodiment, pockets 40, 42 are located on the outer surfaces 64, 66 of the arms 14, 16. Pockets 40, 42 can also be located on the inner surfaces of the arms 14, 16 as well. Similarly, any number of pockets can be positioned anywhere along the pillow body 10.

In the illustrated embodiment, pillow 5 also includes sleeves 50, 52 coupled to the pillow body 10. Sleeves 50, 52 are coupled to arms 14, 16 proximate to ends 18, 20. In one embodiment, the sleeves are coupled within a few inches of the ends 18, 20. In an alternative embodiment, the sleeves are coupled at the ends 18, 20 of the arms 14, 16.

In one embodiment, each sleeve is a single piece of material that is folded into a cylindrical shape or configuration. Two ends 54, 56 of sleeve 52 are coupled to the pillow body 10 as illustrated in FIG. 8. Sleeve 50 is similarly coupled to arm 14.

Once the sleeves are curved, the ends of each sleeve are coupled to body 10. While sleeves 50, 52 are formed from a flexible material, such as a cotton fabric, any material that can be formed into a curved configuration can be used.

In the illustrated embodiment, entertainment device 100 is coupled to the pillow body 10. Entertainment device 100 includes an elongate member 110 with ends 112, 114 and medial region 116. In the illustrated embodiment, the elongate member 110 is a bar 110 and is herein referred to as bar 110.

When the bar 110 is formed into a curved configuration, the ends 112, 114 are inserted into sleeves 50, 52. The tendency of the bar 110 to return to an extended or open position provides the necessary frictional contact between the ends 112, 114 and the inner surface of the sleeves 50, 52 to retain the bar ends 112, 114. Accordingly, bar 110 is retained in a curved configuration as illustrated in FIG. 6 when it is coupled to the pillow body 10.

Entertainment device 100 includes a plurality of articles 130, 132,134 that are coupled to the bar 110. In the illustrated embodiment, articles 130, 132, 134 are coupled to the bar 110 by coupling mechanisms 150, 152, 154, respectively.

In one embodiment, coupling mechanisms 150, 152, 154 include a set of straps 120, 122, 124 coupled to the bar 110 and a set of straps 140, 142, 144 coupled to the articles. Each of the straps 140, 142, 144 has a fastening mechanism that can be coupled to the fastening mechanisms of straps 120, 122, 124. For example, straps 120, 122, 124 can have hook fasteners coupled thereto and straps 140, 142, 144 can have loop fasteners coupled thereto. The hook fasteners can be releasably coupled to the loop fasteners. Accordingly, articles 130, 132, 134 can be releasably coupled to the bar 110. Any type and any number of toys or other articles can be coupled to the bar 110.

In the illustrated embodiment, the bar 110 is flexible and covered with a fabric material, such as a cotton fabric. Bar 110 can also be resilient and fixed into its curved configuration.

Fastening mechanisms other than hook and loop fasteners can be used to couple toys or other entertainment articles to the bar. For example, hooks, clips, and other connecting devices can be used.

While the invention has been described in detail and with reference to specific embodiments thereof, it will be appreciated that various changes and modifications can be made therein without departing from the spirit and scope thereof. Thus, it is intended that the present invention covers the modifications and variations of this invention provided they come within the scope of the appended claims and their equivalents.

What is claimed is:

1. A pillow for supporting an infant comprising:

a substantially U-shaped body including a medial region and first and second cantilever arms extending therefrom, each of said first and second cantilever arms including an end, an inner surface, and an outer surface opposite to said inner surface, said body including a first sleeve coupled to said outer surface of said first cantilever arm and a second sleeve coupled to said outer surface of said second cantilever arm, each of said first sleeve and said second sleeve having a substantially cylindrical configuration; and an elongate member having a first end and a second end, said first elongate member end coupled proximate to said first cantilever arm end to said first sleeve, and said second elongate member end coupled proximate to said second cantilever arm end to said second sleeve.

2. The pillow of claim 1, wherein said first sleeve is coupled proximate to said first cantilever arm end and said second sleeve is coupled proximate to said second cantilever arm end, said first elongate member end being inserted into said first sleeve, and said second elongate member end being inserted into said second sleeve.

3. The pillow of claim 1, wherein said inner surface of said first cantilever arm is substantially parallel to said outer surface of said first cantilever arm.

4. A method of assembling a pillow having a medial region and first and second cantilever arms extending therefrom, the first cantilever arm including an end, an inner surface, an outer surface opposite its inner surface, and a first sleeve coupled to the first cantilever arm outer surface proximate to the first cantilever arm end, the first sleeve having a substantially cylindrical configuration, the second cantilever arm including an end, an inner surface, an outer surface opposite its inner surface, and a second sleeve coupled to the second cantilever arm outer surface proximate to the second cantilever arm end, the second sleeve having a substantially cylindrical configuration, the method comprising:

forming an elongate member into a U-shaped configuration, said elongate member having a first end and a second end;

coupling said first end of said elongate member to the first sleeve; and coupling said second end of said elongate member to the second sleeve.

5. The method of claim 4, wherein said coupling said first end includes inserting said first elongate member end into the first sleeve and said coupling said second end includes inserting said second elongate member end into the second sleeve.

6. A pillow for supporting an infant comprising:

a substantially U-shaped body including a medial region and first and second cantilever arms extending therefrom, each of said first and second cantilever arms including an end, said body including a first sleeve coupled to an outer surface of said first cantilever arm proximate to said first cantilever arm end and a second sleeve coupled to an outer surface of said second cantilever arm proximate to said second cantilever arm end, each of said first and second sleeves having a substantially cylindrical configuration, said first cantilever arm including an inner surface, said inner surface being substantially parallel to said outer surface of said first cantilever arm; and an elongate member coupled to said body, said elongate member having a first end and a second end, said first elongate member end being inserted into said first sleeve, and said second elongate member end being inserted into said second sleeve.

7. A pillow for supporting an infant comprising:

a substantially U-shaped body including a first arm and a second arm, said first arm including an end, an outer surface, and a first substantially cylindrical sleeve coupled to said first arm outer surface, said second arm including an end, an outer surface, and a second substantially cylindrical sleeve coupled to said second arm outer surface; and an elongate member having a first end and a second end, said first end of said elongate member coupled to said first arm sleeve, said second end of said elongate member coupled to said second arm sleeve.

8. The pillow of claim 7, wherein said first sleeve is coupled to said body proximate to said end of said first arm and said second sleeve is coupled to said body proximate to said end of said second arm.

9. The pillow of claim 7, wherein said first end of said elongate member is inserted into said first sleeve, and said second end of said elongate member is inserted into said second sleeve.

* * * * *